US006786579B2

(12) United States Patent
Noolandi et al.

(10) Patent No.: US 6,786,579 B2
(45) Date of Patent: Sep. 7, 2004

(54) DEVICE FOR DISPENSING PARTICULATE MATTER AND SYSTEM USING THE SAME

(75) Inventors: Jaan Noolandi, Mississauga (CA); Eric Peeters, Fremont, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/323,231

(22) Filed: Dec. 18, 2002

(65) Prior Publication Data

US 2004/0119795 A1 Jun. 24, 2004

(51) Int. Cl.[7] ..... B41J 2/175
(52) U.S. Cl. ..... 347/85; 347/21
(58) Field of Search ..... 347/20, 21, 43, 347/46, 54, 55, 65, 67, 93; 406/89

(56) References Cited

U.S. PATENT DOCUMENTS

| | | | | |
|---|---|---|---|---|
| 5,818,477 A | * | 10/1998 | Fullmer et al. | 347/43 |
| 6,116,718 A | | 9/2000 | Peeters et al. | |
| 6,227,768 B1 | * | 5/2001 | Higuchi et al. | 406/89 |
| 6,293,659 B1 | | 9/2001 | Floyd et al. | |
| 6,328,409 B1 | | 12/2001 | Peeters et al. | |
| 6,328,436 B1 | | 12/2001 | Floyd et al. | |
| 6,340,216 B1 | | 1/2002 | Peeters et al. | |
| 6,416,157 B1 | | 7/2002 | Peeters et al. | |
| 6,416,158 B1 | | 7/2002 | Floyd et al. | |
| 6,416,159 B1 | | 7/2002 | Floyd et al. | |
| 6,454,384 B1 | | 9/2002 | Peeters et al. | |
| 6,467,862 B1 | | 10/2002 | Peeters et al. | |

OTHER PUBLICATIONS

N. A. Fuchs, *The Mechanics of Aerosols*, pp. 367–373, The Macmillan Company, 1964.

* cited by examiner

*Primary Examiner*—Anh T.N. Vo
(74) *Attorney, Agent, or Firm*—Fay, Sharpe, Fagan, Minnich & McKee, LLP

(57) ABSTRACT

A particulate dispensing device includes a housing having a wall at least partially forming a housing cavity. A dispersive element and a particulate filter are each supported in the housing cavity in spaced relation to one another forming a fluidizing chamber. A dispensing tube extends from the fluidizing chamber for dispensing fluidized particulates or aerosol from the device. The particulate dispensing device generates the fluidized particulates or aerosol from a particulate bed within the fluidizing chamber, and dispense the particulates through the dispensing tube to a downstream delivery site. One or more dispensing devices can be used in a system to deliver the fluidized particulate matter to the delivery site. In one system a delivery line from an associated dispensing device directly delivers particulate matter to the delivery site. In another system, each delivery line of one or more dispensing devices delivers particulate matter to an associated delivery member that includes a longitudinally extending channel having an exit orifice. A propellant source is in fluid communication with a propellant port in the channel, and provides propellant flow along the channel. The dispensing lines deliver the fluidized particulate matter or aerosol into the propellant flow. The delivery site is supported adjacent the exit orifice such that the propellant flow and particulate matter therein are delivered to the delivery site.

29 Claims, 15 Drawing Sheets

DEVICE FOR DISPENSING PARTICULATE MATTER AND SYSTEM USING THE SAME

INCORPORATION BY REFERENCE

The present invention relates to particulate dispensing devices and system, such as could be used in the manufacture of pharmaceutical and non-pharmaceutical grade pills, for example. Certain details of the present invention, such as, but not limited to, electrostatic gates, for example, are similar to those used in association with ballistic aerosol marking devices and procedures that are described in more detail in Peeters, U.S. Pat. No. 6,116,718 and Floyd, U.S. Pat. No. 6,293,659, each of which is hereby incorporated herein by reference in its entirety. Additionally, "The Mechanics of Aerosols" by Fuchs, §58, pp. 367–373 (Pergamon Press, 1964) is hereby incorporated herein by reference for specifics on the parameters for creating fluidization.

The subject invention relates to the art of particulate dispensing technologies and, more particularly, to a device for dispensing particulate matter and a system for delivering the dispensed particulate matter to a processing site or apparatus.

BACKGROUND OF THE INVENTION

The present invention relates generally to the art of particulate dispensing technologies. It finds particular application in conjunction with the manufacture of pharmaceutical and non-pharmaceutical grade pills and will be described with particular reference thereto in the present application. However, it is to be appreciated that the invention is equally applicable for use in the manufacture of other products. One such example is in the area of powder coating, where a charged coating material, in particulate form, is delivered to an oppositely charged item to which the coating material is attracted and sticks. The coating material can be delivered in patterns of colors to provide a decorative coating or to print characters or symbols on the item, for example. The coated item is thereafter subjected to an elevated temperature causing the individual powder coating particulates to fuse together forming a smooth finished surface. As such, the invention of the present disclosure finds broad application in other areas of manufacture and is not intended to be limited to applications relating to pill manufacturing.

The manufacture of pills, such as tablets and capsules, for example, is long established and generally well known. One traditional method of manufacturing such pills is to blend together the proportionally appropriate amounts of various active ingredients or chemicals with other inactive or filler ingredients. These are typically dry materials in powder form having particulate sizes of from about 5 $\mu$n to about 250 $\mu$n. The batch of blended ingredients is then delivered to a machine that compresses the ingredients into a pill of the desired shape, such as a tablet, for example.

One disadvantage of such a process, however, is that to cost effectively produce such pills, the active and inactive ingredients are commonly blended together in large batches. The blended, bulk material is then delivered in metered shots to the machine that compresses the ingredients into the desired shape. Theoretically, each resulting pill would have the exact proportions of desired active and inactive ingredients. However, while the blending process is generally carefully controlled and thorough, it is not, in practice, possible for the proportionally exact amounts of active and inactive ingredients to be contained in each shot that is metered into the machine, when the ingredients are blended in bulk as discussed above. As such, any given shot of blended ingredients is likely to have a greater or lesser amount of each of the active ingredients than is otherwise intended. As such, the pill formed from such a shot will deliver the incorrect of amount of the active ingredients after ingestion.

Another disadvantage of such a traditional manufacturing method is the limited ability of such a known method to produce time-released pills. More and more, it is being found desirable to have different chemicals or ingredients of a pill be released at times that are different from one another, or to have certain more concentrated doses released at certain, predetermined intervals. While pills made from compressed metered shots of batch ingredients are generally able to dissolve over a controlled period of time and thereby release the active ingredients therein in a time-dependent manner, the method of manufacturing by its very nature strives to produce a uniformly blended pill. As such, it is not possible to have increased or decreased quantities of certain ingredients placed in specific positions throughout the pill to thereby release these ingredients at certain time-specific points in the ingestion process.

Other methods of manufacturing pills have been developed of late that produce pills having a variety of different chemicals or ingredients. These pills are better suited to release certain active ingredients at certain time-related points in keeping with more recent interests. One such method is solvent casting. Using this method, a solution of a carrier solvent and one or more dissolved active ingredients or chemicals is deposited on a pill substrate. The solvent is allowed to evaporate, leaving the dissolved ingredients deposited on the pill substrate. By repeating this process and varying the concentration of the dissolved active ingredients, a multi-layered pill can be manufactured that can time-release ingredients at desired intervals. This process also has disadvantages, however. One such disadvantage is that the process is still subject to the same batch mixing issues discussed above. Only here, however, the issue is the potential uneven concentrations of ingredients mixed in the solvent, instead of the potential uneven blending of dry, powdered ingredients, as in earlier processes. Furthermore, the process tends to be relatively slow, as time is required for the solvent to evaporate from the pill. What's more, the costs associated with handling and processing solvents and other liquids can be high.

Yet another disadvantage of current pill manufacturing devices and systems is the commonly high per pill cost that generally results from manufacturing a given pill in a small or-otherwise limited quantity. This is, in part, due to the significant amount of time and effort that is typically required to set up such arrangements in preparation for production. Current mass production arrangements that utilize bulk quantities of blended ingredients simply cannot cost-effectively manufacture small quantities of pills. As such, it is not possible to cost-effectively produce pills on an "as needed" or "on demand" basis. Furthermore, such arrangements are not particularly well suited for product development, where a small quantity of pills are made for each of numerous different pill compositions and/or configurations.

SUMMARY OF THE INVENTION

In accordance with the present invention, a device for dispensing particulate matter and a system using the same are provided and can be used in various applications, such as the manufacture of pharmaceutical and non-pharmaceutical grade pills, for example. Such use of the present device and system can be used to avoid or minimize the problems and disadvantages encountered in connection with known pill manufacturing systems of the foregoing character, while promoting the efficient manufacture of pills having complex configurations, providing flexibility in the manufacturing process, minimizing setup and preparation time, and maintaining a desired simplicity of structure and economy of manufacture.

More particularly in this respect, a particulate dispensing device is provided that includes a housing having a housing wall and a housing cavity at least partially formed by the housing wall. A dispersive element is supported in the housing cavity, and a particulate filter is also supported in the housing cavity in spaced relation to the dispersive element forming a fluidizing chamber therebetween in conjunction with the housing wall. A dispensing tube has a tube wall forming a dispensing passage that is in fluid communication with the fluidizing chamber for dispensing particulate matter therefrom.

Additionally, a system for delivering particulate matter to a processing site, apparatus or other target is provided that includes a particulate dispensing device and a fluid source. The particulate dispensing device has a housing with a housing wall that at least partially forms a housing cavity within the housing. A dispersive element and a particulate filter are each supported in the housing cavity. The dispersive element and particulate filter are spaced apart from one another forming a fluidizing chamber therebetween in conjunction with the housing wall. A dispensing tube includes an intake opening positioned within the fluidizing chamber, a delivery opening, and a dispensing passage that extends between the intake and delivery openings. The housing also includes a fluid inlet passage and a fluid outlet passage that are each in fluid communication with the housing cavity, and the fluid source is in fluid communication with the fluid inlet passage.

A method of delivering particulate matter to a delivery site is provided that includes the steps of providing a fluidizing chamber and a quantity of particulate matter, fluidizing the first quantity of particulate matter, and delivering a portion of the fluidized particulate matter to the delivery site.

DETAILED DESCRIPTION OF THE INVENTION

Figure 1:
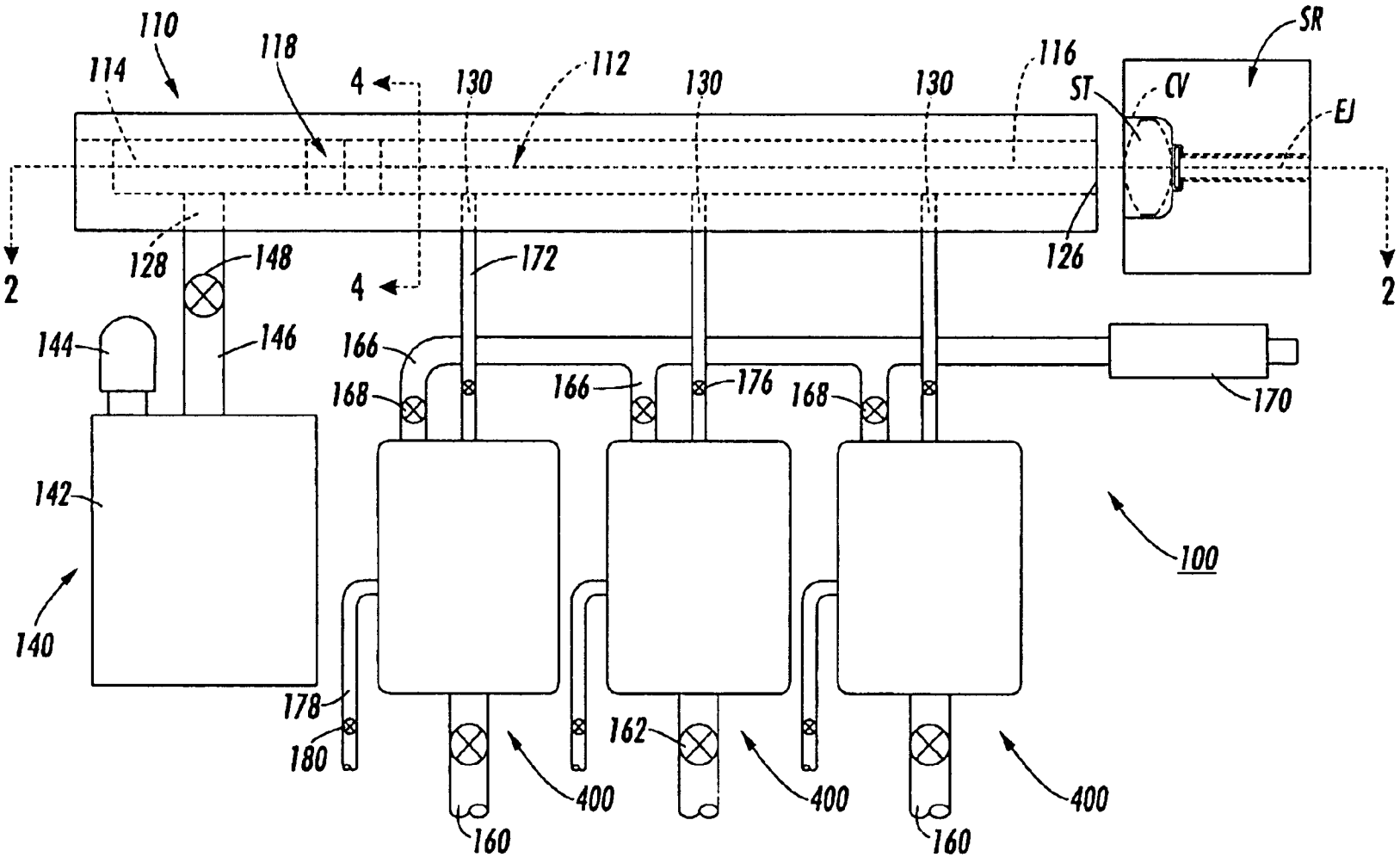
FIG. 1 is a side elevation view of one embodiment of a system for delivering particulate matter in accordance with the present invention.

Referring now in greater detail to the drawings, wherein the showings are for the purposes of illustrating preferred embodiments of the invention only, and not for the purpose of limiting the invention, FIG. 1 illustrates a system 100 for dispensing and delivering particulate matter to a processing site or apparatus in accordance with one embodiment of the present invention. The system includes a delivery member 110, a propellant source 140 and a plurality of particulate dispensing devices 400. As discussed above, the present invention can be used to deliver particulate matter to a processing site, apparatus or other target (broadly referred to hereinafter as a delivery site) in any suitable application or environment. One such application is in the manufacture of pharmaceutical and non-pharmaceutical grade pills, such as tablets, capsules, caplets and other similar products, and specific reference is made to this particular application throughout the present discussion. However, it is emphasized that the present invention is applicable to a broad range of applications and uses, and it is not intended to be limited in any way to the pill manufacturing applications referenced herein. Accordingly, a delivery site, such as a substrate ST, is supported adjacent the delivery member by a support structure SR that includes a cavity CV and an ejector EJ. It will be appreciated that other delivery sites can include a cavity, such as a capsule half or a compression mold chamber.

Figure 2:
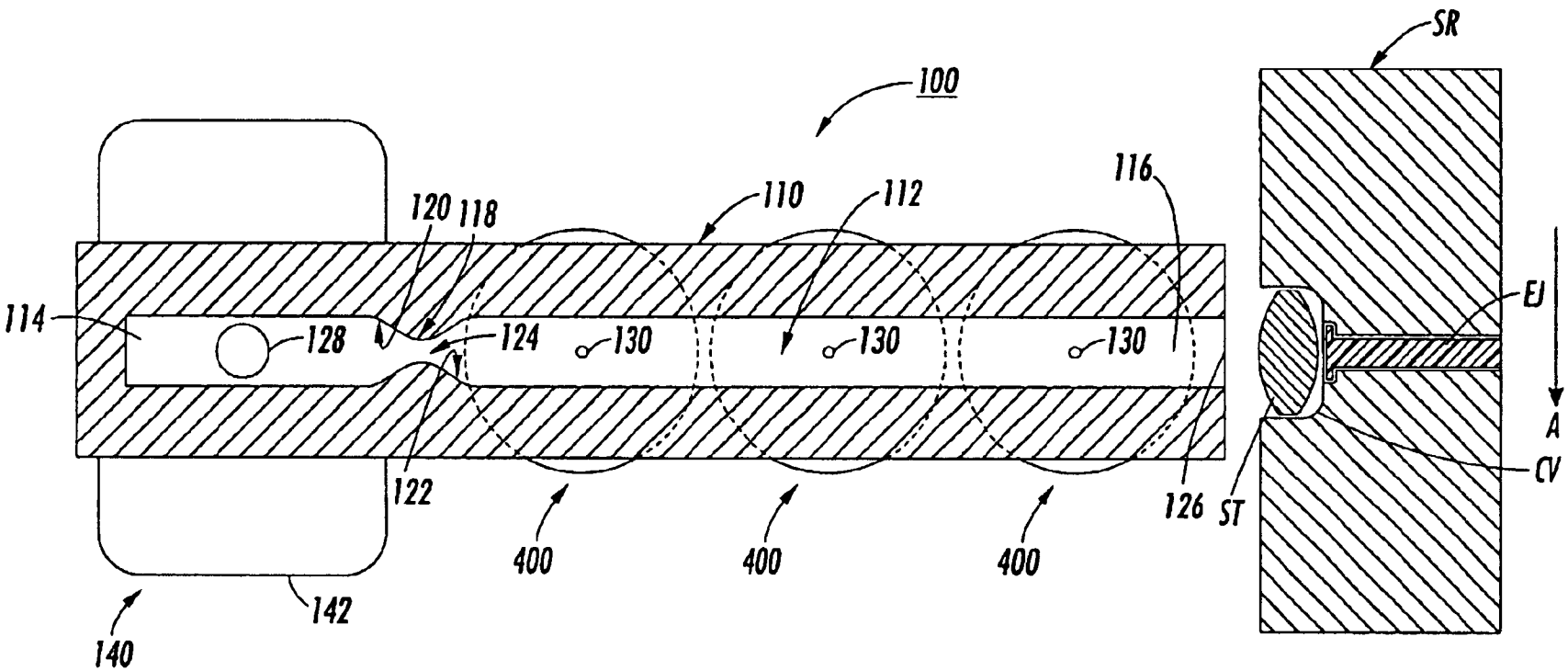
FIG. 2 is a top plan view, in cross-section, of the system shown in FIG. 1 taken generally along line 2—2.

As can be better seen in FIG. 2, delivery member 110 includes a longitudinally disposed delivery channel 112 extending between a proximal end 114 and a distal end 116 thereof. A nozzle 118 is optionally disposed along the channel between the proximal and distal ends. The nozzle includes a converging region 120 and a diverging region 122. The point of transition between the converging region and the diverging region is referred to as throat 124. The general shape of such a channel is sometimes referred to as a de Laval expansion pipe. An exit orifice 126 is located at the distal end of the channel. Additionally, a propellant port 128 and one or more particulate dispensing ports 130 are disposed along the channel. Preferably, the propellant port is located toward the proximal end of the channel and upstream of the nozzle (if provided), and the particulate dispensing ports are located downstream of the nozzle (if provided).

Turning again to FIG. 1, propellant source 140 includes a compressor 142, a propellant intake 144, and a propellant delivery line 146. A valve 148 can optionally be provided along propellant delivery line 146 for selectively permitting or modifying a characteristic of the propellant flow therethrough. The propellant delivery line extends between compressor 142 and port 128 of channel 112. In the present embodiment, the propellant is provided by any one of various suitable compressor types. Preferably, the compressor rapidly turns on to provide a supply of propellant at a steady pressure and/or velocity. Additionally, it may be advantageous to selectively actuate valve 148 so as to permit only propellant at operating pressure and/or velocity to enter channel 112. In such case, valve 148 can be a valve having only an open or full-flow position and a closed or no-flow position. In other applications, however, it may be desirable to use a valve having one or more intermediate or partial-flow positions.

It will be appreciated that, in one application, the present invention, which includes one or more particulate dispensing devices 400 in this embodiment of system 100, is suitable for manufacturing pills, such as pharmaceutical grade or non-pharmaceutical grade tablets, for example. The system is suitable for producing pills that are made up of multiple layers (not shown) comprised of one or more chemicals, drugs, binders, adhesives, fillers, active and inactive ingredients, etc. (hereinafter collectively referred to as particulates or particulate matter). Each of the layers of a pill can be comprised of active and inactive ingredients and may be separated by a binder or adhesive layer, such as to facilitate manufacturing, for example. A layer of particulates is applied to substrate ST, either directly or indirectly, by essentially launching a quantity of particulates at the substrate with sufficient kinetic energy to impinge the particulates upon the substrate. In one embodiment, the particulates are launched by delivering the same into the propellant stream that is flowing along delivery channel 112 toward the substrate. The propellant stream can be a high-velocity flow of propellant that is provided by a high-velocity propellant source. However, preferably the propellant will be introduced into the channel at a relatively high pressure, and channel 112 will contain nozzle 118 for converting the high pressure of the propellant to a high-velocity propellant stream. Depending upon the shape of the channel and the configuration of the nozzle, a collimated or focused jet of propellant can be produced that is directed toward the substrate supported adjacent the distal end of the channel.

As mentioned above, the role of the propellant is to impart the particulate matter with sufficient kinetic energy to reach a delivery site, such as-substrate ST. As such, the. velocity and pressure at which the propellant should be provided will at least partially depend upon the particulate matter being delivered along the channel. The propellant may be supplied by a compressor as discussed above, or alternatively by a refillable or non-refillable reservoir, a material phase-change (e.g., solid to gaseous carbon dioxide), or a chemical reaction, for example. In any event, the propellant should be dry and free of contaminants, principally so as not to interfere with the delivery of the particulate matter to the substrate and so as not to cause or induce clogging of the channel. Thus, an appropriate dryer and/or filter (not shown) may be provided between the propellant source and the channel. In general, examples of appropriate propellants include carbon dioxide, clean and dry air, and nitrogen. Preferably, the propellant should be non-toxic and gaseous at room temperature, although gases at elevated or reduced temperatures may be used under appropriate circumstances.

However generated or provided, the propellant enters channel 112 adjacent proximal end 114 and travels longitudinally through the channel so as to exit the same at exit orifice 126. Channel 112 is oriented such that the propellant stream exiting orifice 126 is directed toward the substrate. The nozzle positioned along the channel acts to increase the velocity of the propellant flow through the channel while maintaining the propellant stream in a uniform stream or jet flowing generally parallel with the channel. It will be appreciated that nozzles are generally well known by those skilled in the art, and that any suitable nozzle can be used to establish the desired flow conditions along the channel. It will be further appreciated that in certain applications, such as where coarse delivery patterns are permissible, for example, the desired flow conditions may be achieved without the use of a nozzle along the channel. It will be understood that such arrangements, that is, those without a nozzle, are intended to be included within the scope of the present invention.

FIGS. 1 and 2 show system 100 as having three particulate dispensing devices 400. It will be appreciated, however, that any suitable number of dispensing devices may be used for a given application, without departing from the principles of the present invention. Each dispensing device 400 is in fluid communication with a fluid supply line 160 and a fluid discharge line 166, the latter of which exhausts fluid through vent 170. A valve 162 can optionally be disposed along each fluid supply line 160 to selectively control the flow of fluid therethrough. Additionally, a valve 168 can optionally be provided along each fluid discharge line 166 to selectively control the flow of fluid therethrough. A particulate dispensing line 172 extends between each dispensing device 400 and associated particulate dispensing port 130 in channel 112. A valve 176 can optionally be provided along each dispensing line 172 for selectively controlling the flow of particulate matter therealong. An agitation line 178 is shown extending from each dispensing device 400, and a valve 180 can optionally be provided along each agitation line 178 for selectively controlling the flow of fluid therethrough.

Valves 148, 162, 168, 176 and 180 are shown only schematically in FIG. 1. As such, valves 148, 162, 168, 176 and 180 can be of any suitable type or configuration, such as ball valves, butterfly valves, diaphragm valves, or piezoelectric valves, for example. Preferably, the valves are electrically controlled and/or actuated, and are suitable for rapid cycling between open and closed positions. It may be desirable, in certain applications, for one or more of the valves to be displaceable into one or more intermediate positions between fully open and fully closed, thereby providing adjustability of fluid flow characteristics through the associated line. Furthermore, an electrostatic gate or other type electromagnetic arrangement can be used as a valve. Such an arrangement may be well suited for controlling the flow of particulates through the particulate dispensing line in certain applications, though other uses may also be appropriate and other suitable arrangements, such as a piezoelectric valve, can otherwise be used along the particulate dispensing line.

Figure 3:
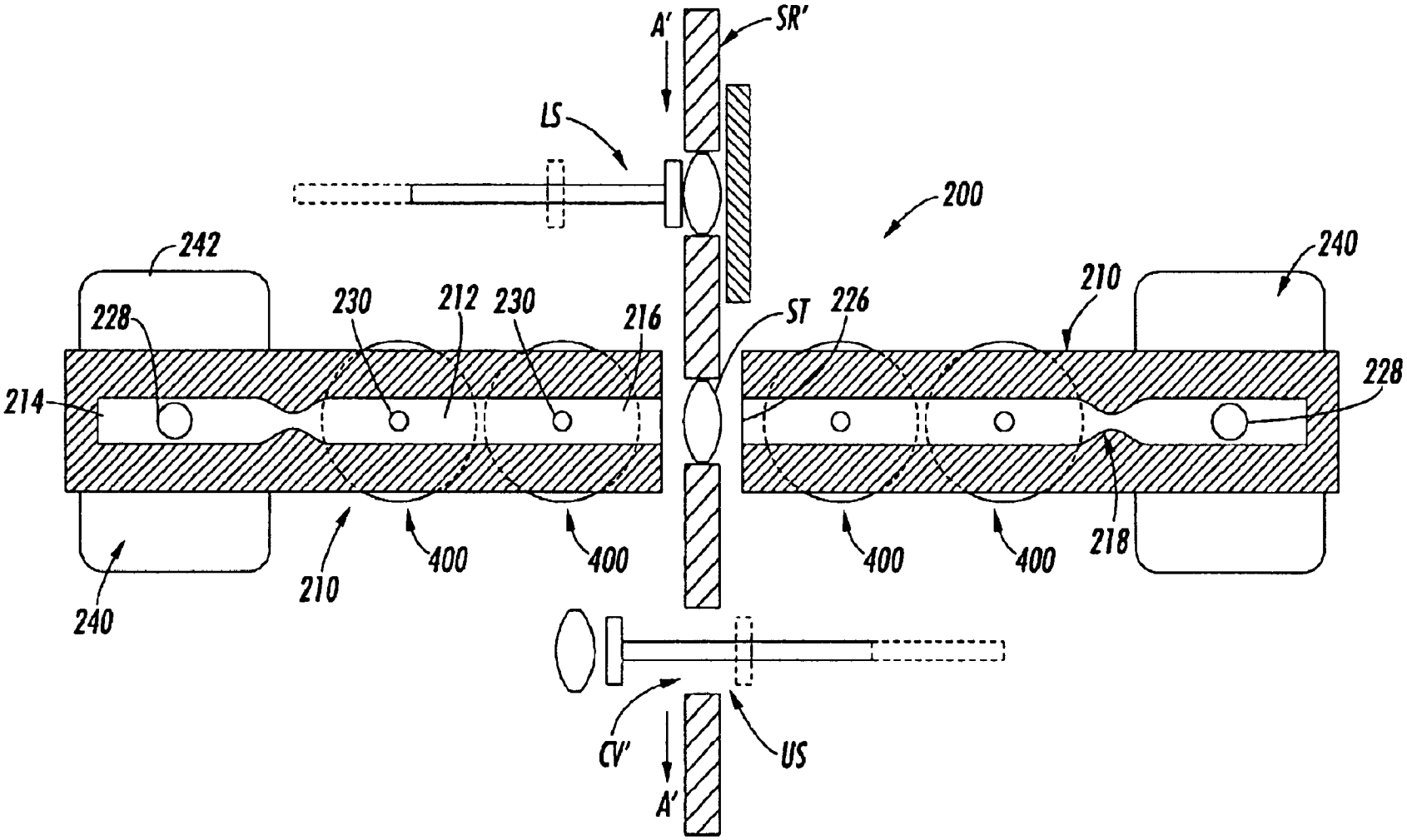
FIG. 3 is a top plan view, in partial cross-section, of an alternate embodiment of a system for delivering particulate matter in accordance with the present invention.

Support structure SR supports a target or delivery site, such as substrate ST, adjacent exit orifice 126 of channel 112. It will be appreciated that support structure SR is displaceable, as indicated by arrow A shown in FIG. 2. Substrate ST is retained in a cavity CV formed in the support structure. It will be appreciated, however, that such an arrangement only permits particulate matter to be applied to one side of the pill at a time. As such, should it be desirable to apply particulate matter to both sides of the pill, then the pill would be ejected from support structure SR and reoriented such that the opposing side is exposed. Alternatively, another embodiment of the present invention could be used, such as system 200 shown in FIG. 3. Unless otherwise indicated, the items in FIG. 3 are substantially similar to those illustrated and discussed with regard to FIGS. 1 and 2. However, the items in FIG. 3 include reference numerals incremented by 100. That is, delivery channel 112 in FIGS. 1 and 2 corresponds to items 212 in FIG. 3, for example. Items shown and described in one drawing figure, but having no counterpart in one or more of the other figures, will be distinctly pointed out and discussed. As such, it will be appreciated that delivery members 210, propellant sources 240 and particulate dispensing devices 400 are substantially similar to those discussed with regard to FIGS. 1 and 2. However, system 200 includes two opposing delivery members 210 and channels 212 each with an associated propellant source 240 and one or more dispensing devices 400 for dispensing particulate matter into the respective channels. As indicated by arrows A', each cavity CV' of support structure SR' moves from a loading station LS to a position between the two opposing exit-orifices of the channels and thereafter to an unloading station US.

It will be appreciated that the present invention can include any suitable number of channels directing particulate matter toward a delivery site. For example, a system could include any number of one or more delivery members each having one or more delivery channels. The delivery members and attendant channels could be directed toward the delivery site at an angle relative to one another and to the direction of travel of the delivery site. As another example, the delivery members and attendant channel or channels could be disposed transverse to the direction of travel of the delivery site, with numerous delivery members extending adjacent one another to deliver particulate matter to the adjacent delivery site in a serial manner.

Figure 4:
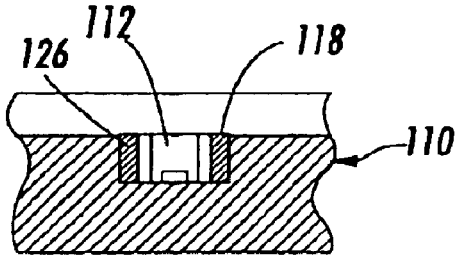
FIG. 4 is a side elevation view, in cross-section, of the channel and nozzle arrangement of FIGS. 1 and 2 taken generally along line 4—4 of FIG. 1.
Figure 5:
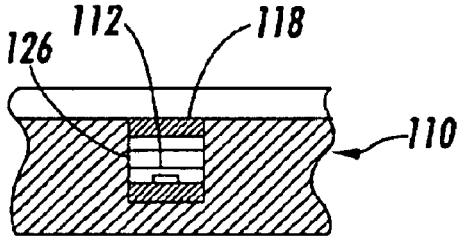
FIGS. 5–10 are side elevation views, in cross-section, of alternate embodiments of the channel and nozzle arrangement shown in FIG. 4.
Figure 6:
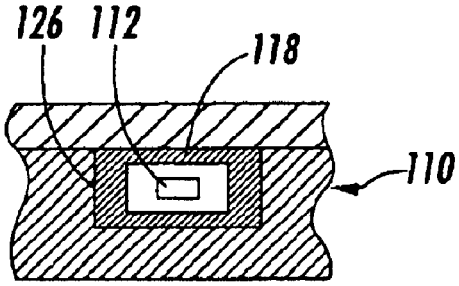
Figure 7:
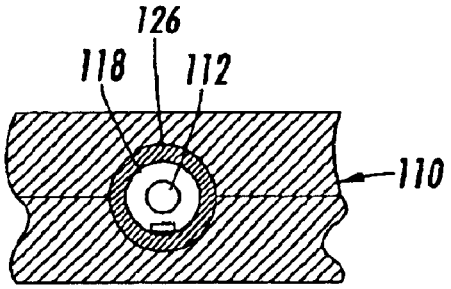
Figure 8:
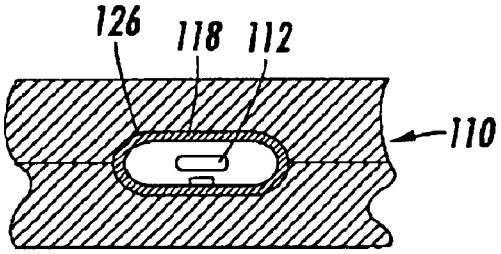
Figure 9:
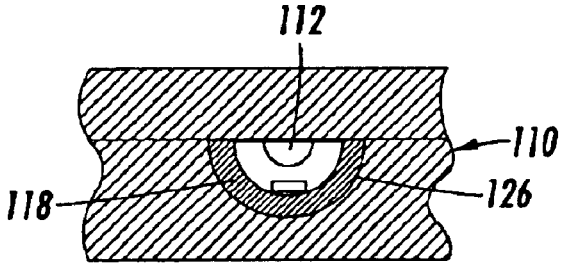
Figure 10:
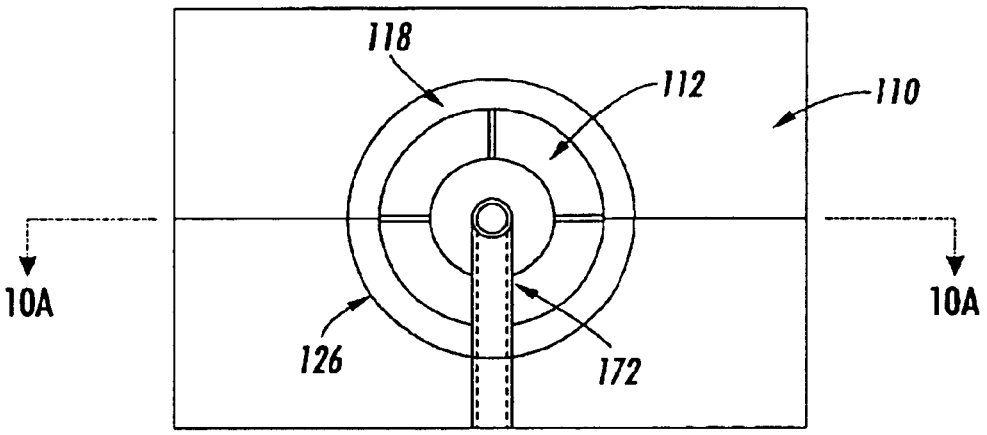
Figure 10A:
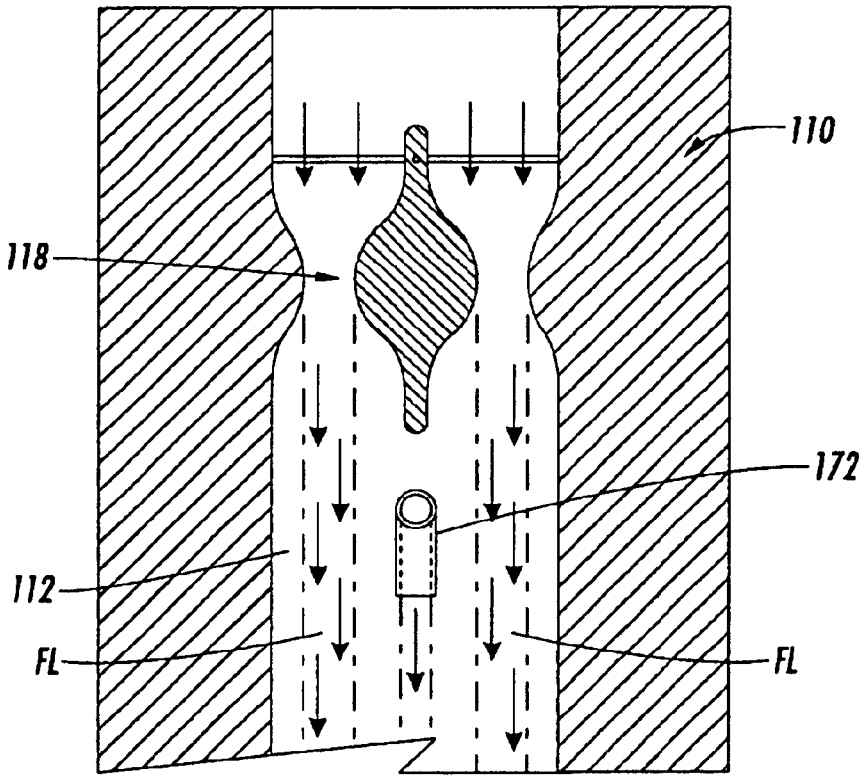
FIG. 10A is a top plan view, in section, of the channel and nozzle arrangement shown in FIG. 10 taken generally along line 10A—10A.

In the embodiments of the present invention shown in FIGS. 1–3, region 120 of nozzle 118 converges in the plane of FIGS. 2 and 3, but not in the plane of FIG. 1. Likewise, region 112 of the nozzle diverges in the plane of FIGS. 2 and 3, but not in the plane of FIG. 1. Typically, the configuration of the nozzle will largely determine the cross-sectional shape of the channel, and preferably, the shape of the exit orifice as well. For example, the shape of channel 112 and exit orifice 126 illustrated in FIG. 4 corresponds to the device shown in FIGS. 1–3. However, the nozzle, channel and exit orifice may be fabricated such that the respective nozzle regions converge/diverge in the plane of FIG. 1, but not in the plane of FIGS. 2 and 3 as illustrated in FIG. 5; or in both the planes of FIGS. 1 and 2, and FIG. 3 as illustrated in FIG. 6; or in all planes or in some other plane or set of planes as illustrated in FIGS. 7–9 as may be determined by the manufacture and application of the present invention. Furthermore, as illustrated in FIG. 10, another channel and nozzle arrangement is provided that forms a hollow, cylindrical propellant stream or jet FL, as shown in FIG. 10A. Particulate matter is dispensed into the central portion of the hollow stream, by particulate dispensing line 146, and is carried along toward the delivery site by propellant flow FL surrounding the particulate matter.

Figure 11:
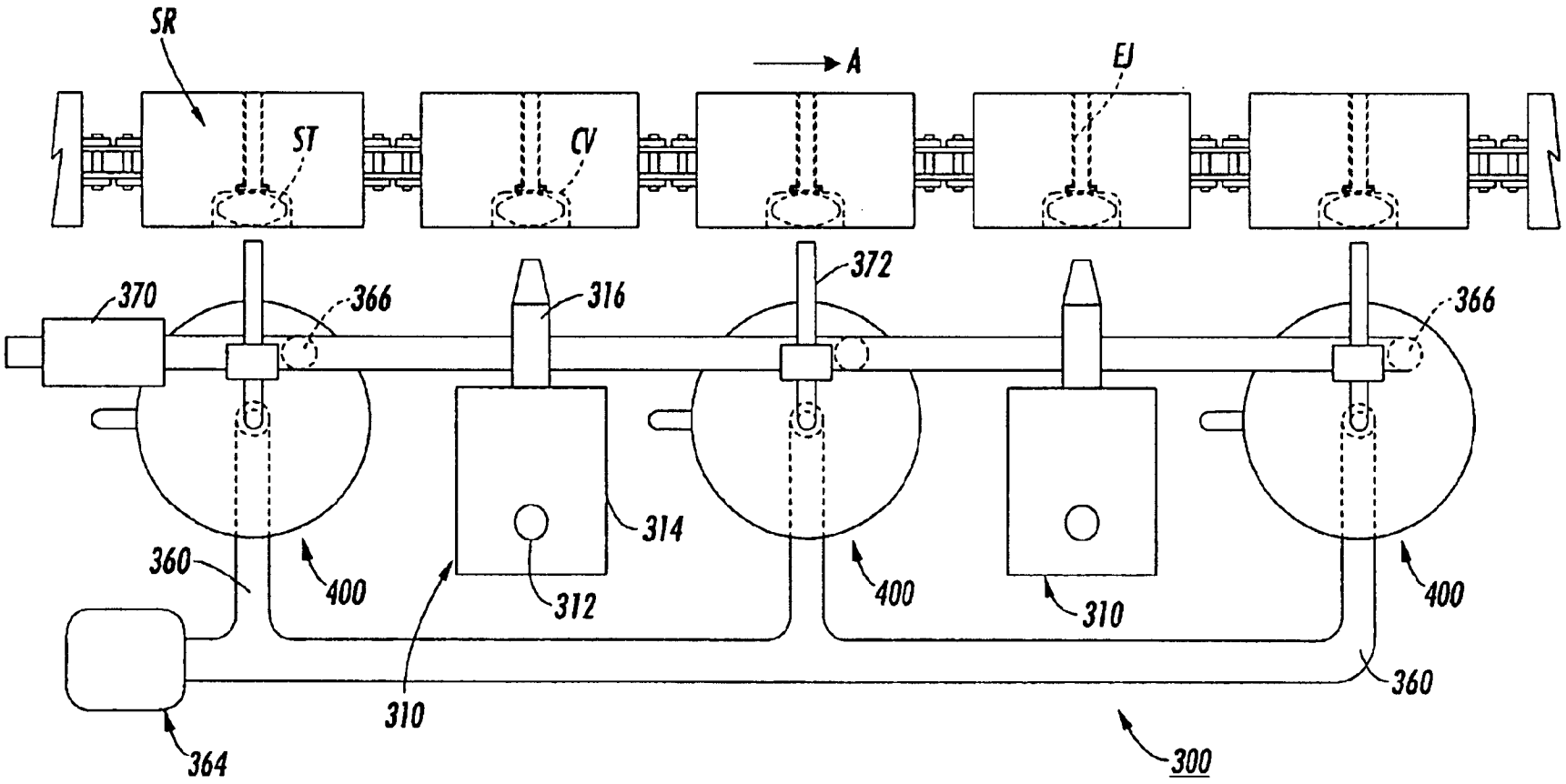
FIG. 11 is a top plan view of still another alternate embodiment of a system for delivering particulate matter in accordance with the present invention.
Figure 12:
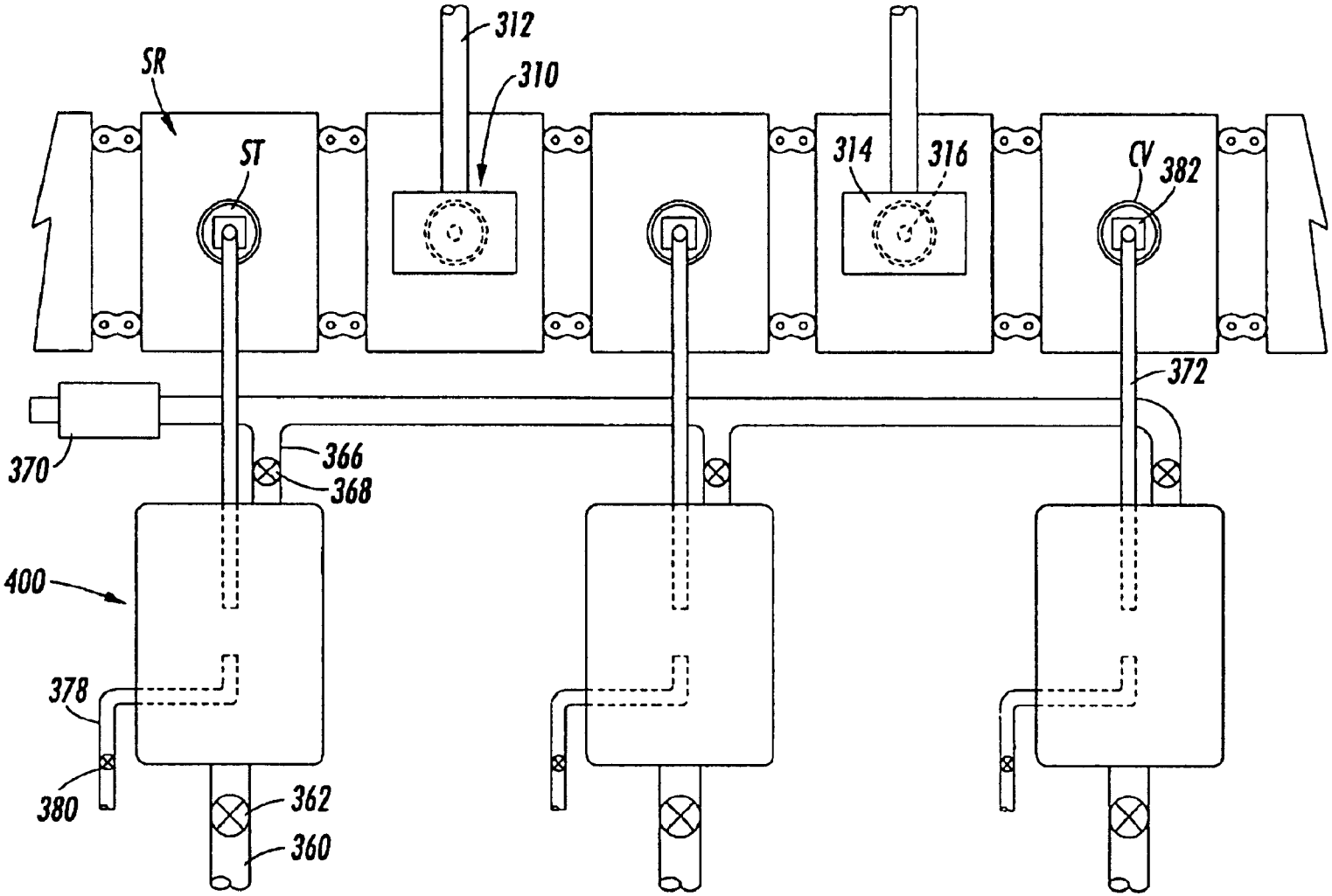
FIG. 12 is a side elevation view of the system for delivering particulate matter shown in FIG. 11.

Yet another embodiment of a system 300 for delivering particulate matter to a delivery site is shown in FIGS. 11 and 12. The system includes one or more particulate dispensing devices 400 and can optionally include one or more adhesive dispensers 310. It will be appreciated that system 300 does not include a delivery member, delivery channel, propellant source or other associated items as are included and discussed with regard to FIGS. 1–3. Each particulate dispensing device 400 in system 300 is in fluid communication with a fluid supply line 360 and a fluid discharge line 366. The fluid supply lines are in fluid communication with a fluid source 364, and fluid discharge lines 366 exhaust fluid through vent 370. It will be appreciated, however, individual fluid sources and exhausts such that vent 370 are optional. As such, discharge lines 366 can be adapted to vent individually to atmosphere or another suitable exhaust device. A valve 362 can optionally be disposed along each fluid supply line 360 to selectively control the flow of fluid therethrough. Additionally, a valve 368 can optionally be provided along each fluid discharge line 366 to selectively control the flow of fluid therethrough. A particulate dispensing line 372 extends from each dispensing device 400 and has an open end positioned adjacent an associated delivery site, such as substrate ST. A valve (not shown) can optionally be provided along each dispensing line 372 for selectively controlling the flow of particulate matter therealong. An agitation line 378 is shown extending from each dispensing device 400, and a valve 380 can optionally be provided along each agitation line 378 for selectively controlling the flow of fluid therethrough. It will be appreciated that the valves can be of any suitable type or configuration as discussed hereinbefore. Optionally, a nozzle arrangement 382, of suitable type or configuration, as discussed hereinbefore, can be included along particulate dispensing line 372 for providing the desired flow characteristics therealong.

The target or delivery site, such as substrate ST, is supported on a support structure SR having a cavity CV for receiving the substrate and an ejector EJ, as discussed in detail hereinbefore. It will be appreciate that support structure SR can be any suitable type of conveyor or other support apparatus and is shown moving in a direction as indicated by arrow A. The support structure may be continuously moving or alternately can stop or pause at selected delivery positions.

Optionally, adhesive dispensers 310 can be included in system 300. The adhesive dispensers include an adhesive supply line 312, a valve body 314 and nozzle arrangement 316. It will be appreciated that any suitable adhesive in any suitable form can be output by dispensers 310 including water, adhesive gel or any other suitable adhesive.

Preferably, the particulates supplied to the propellant stream are generated in a fluidized or aerosol form above a bed of particulates. The bed is preferably excited by gas flow and/or sonic or ultrasonic vibration, or alternately the bed can be excited by mechanical/gas excitation with a rotating mechanical arm, such as a propeller. As such, particulate dispensing device 400, shown in FIG. 13, includes a housing 410 having a top wall 412, a bottom wall 414 and a side wall 416 extending therebetween. The walls define a housing cavity 418 having a housing inlet 420 and a housing outlet 422, each in fluid communication with the housing cavity. In the present embodiment, bottom and side walls 414, 416 are integrally formed, and top wall 412 is separate therefrom. Top wall 412 can be secured to side wall 416 in any suitable manner, such as by using fasteners 424 engaging threaded holes 426. A sealing member, such as an o-ring 430, is disposed between the top and side walls in respective opposing grooves 432 and 434 to form a fluid-tight seal therebetween. A dispersive element 440 and a particulate filter 442 are each supported within housing cavity 418. Element 440 is adjacent bottom wall 414, and particulate filter 442 is supported adjacent top wall 412. As such, element 440 and filter 442 are in spaced relation to one another forming a fluidizing chamber 444 therebetween with side wall 416. Preferably, element 440 and filter 442 are supported within the housing such that fluid flowing through the housing inlet and outlet is generally unable to flow around either the element or the filter. As such, any suitable sealing arrangement (not shown) formed respectively between the housing and the element and the filter can be used. A quantity of particulates 472 is shown in fluidizing chamber 444 in the form of a particulate bed 474. A passage 446 extends through top wall 412 and particulate filter 442. A particulate dispensing tube 448 having an open end 450 extends through passage 446 into fluidizing chamber 444. It will be appreciated that, in practice, dispensing tube 448 and dispensing line 372 (or 172) can be either joined in a suitable manner or can be of a unitary construction. The dispensing tube is secured in passage 446 by a suitable sealing member, such as a grommet 452. Additionally, an agitation tube 454 having an open end 456 extends into fluidizing chamber 444 in housing 410 through a passage 456 in side wall 416. A suitable sealing member, such as grommet 458, secures agitation tube 454 in passage 452. It will be appreciated that, in practice, agitation tube 454 and agitation line 378 (or 178) can be either joined in a suitable manner or can be of a unitary construction. In a preferred arrangement, open ends 450 and 456 respectively of particulate dispensing tube 448 and agitation tube 454 are spaced apart from one another. In a more preferred arrangement, tubes 448 and 454 will be oriented in generally coaxial alignment with one another. However, it will be specifically understood that such a coaxial alignment of tubes 448 and 454 is optional, and that non-aligned tubes be suitable in certain applications. A vibration source, such as an acoustic speaker 460, can be supported on or adjacent housing 410 for providing sonic or ultrasonic vibration to fluidizing chamber 444. A level sensor 462 extends through side wall 416 and is suitably adapted to output a signal relative to the particulate level within the fluidizing chamber. Any suitable sensor arrangement can be used to determine the particulate density, such as an optical sensor, for example. Additionally, a supply arrangement 464, such as an auger or auger wheel, for example, extends through side wall 416 for selectively replenishing the. particulate matter within fluidizing chamber 444.

Dispersive element 440 can take the form of a glass frit, a narrow weave, wire mesh or other similar structure. Preferably, the dispersive element will have pores or passages therethrough of suitable size and configuration to allow the passage of fluid while retaining the particulate matter within the fluidizing chamber. For example, where a particulate matter has a dimension of about 200 $\mu$m to about 250 $\mu$m, then it would be desirable to employ a dispersive element having a pore or passage size of about 5 $\mu$m to about 150 $\mu$n. It will be appreciated that element 440 will preferably have dispersive properties with regard to the air flowing therethrough. Particulate filter 442, however, need not have such dispersive characteristics, as the particulate filter functions to simply retain the particulate matter within the fluidizing chamber while allowing the fluidizing fluid to pass out of the chamber.

Figure 13:
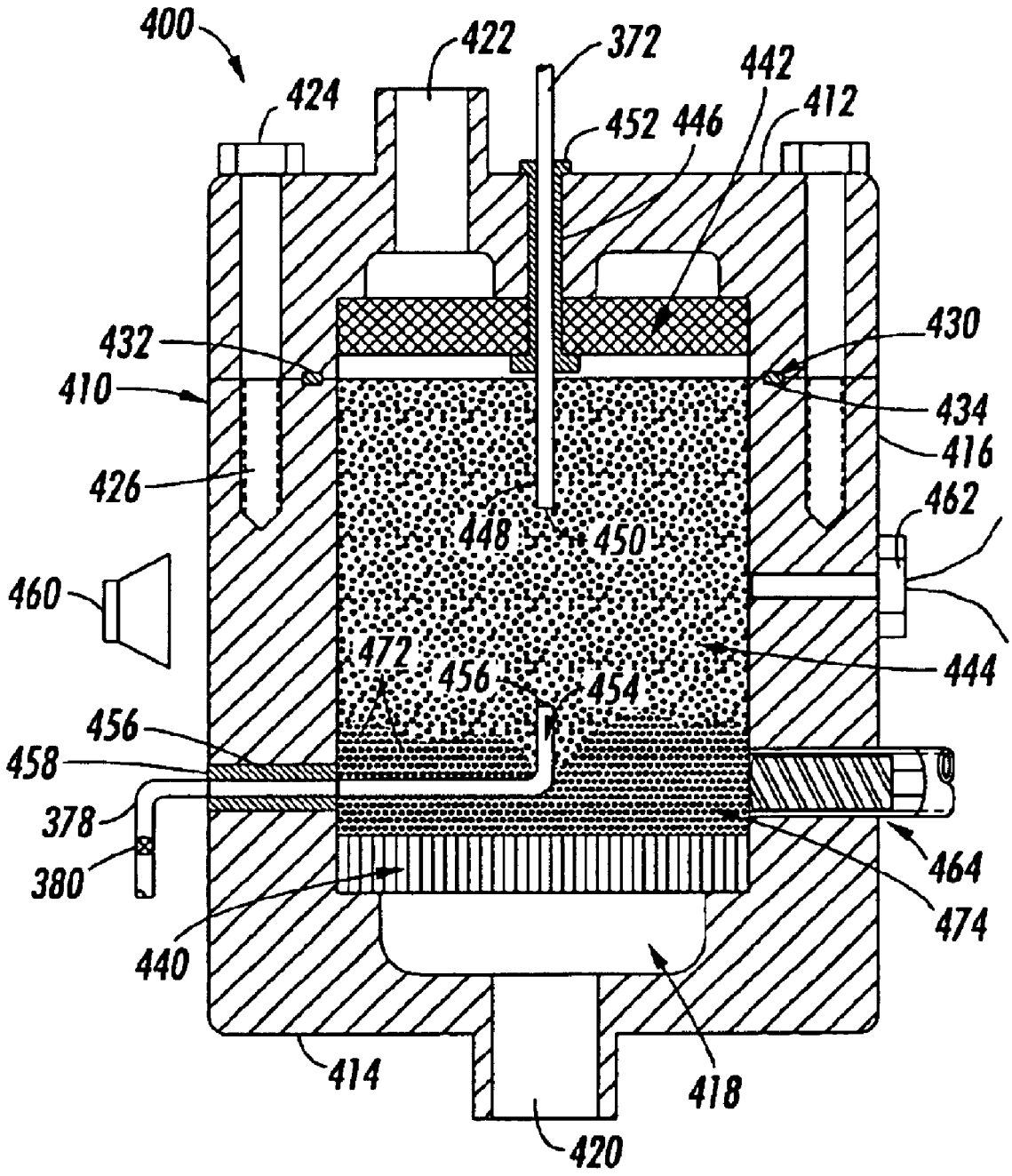
FIG. 13 is a side elevation view, in partial cross-section, of one embodiment of a particulate matter dispensing device in accordance with the present invention shown with a non-fluidized bed of particulate matter.
Figure 14:
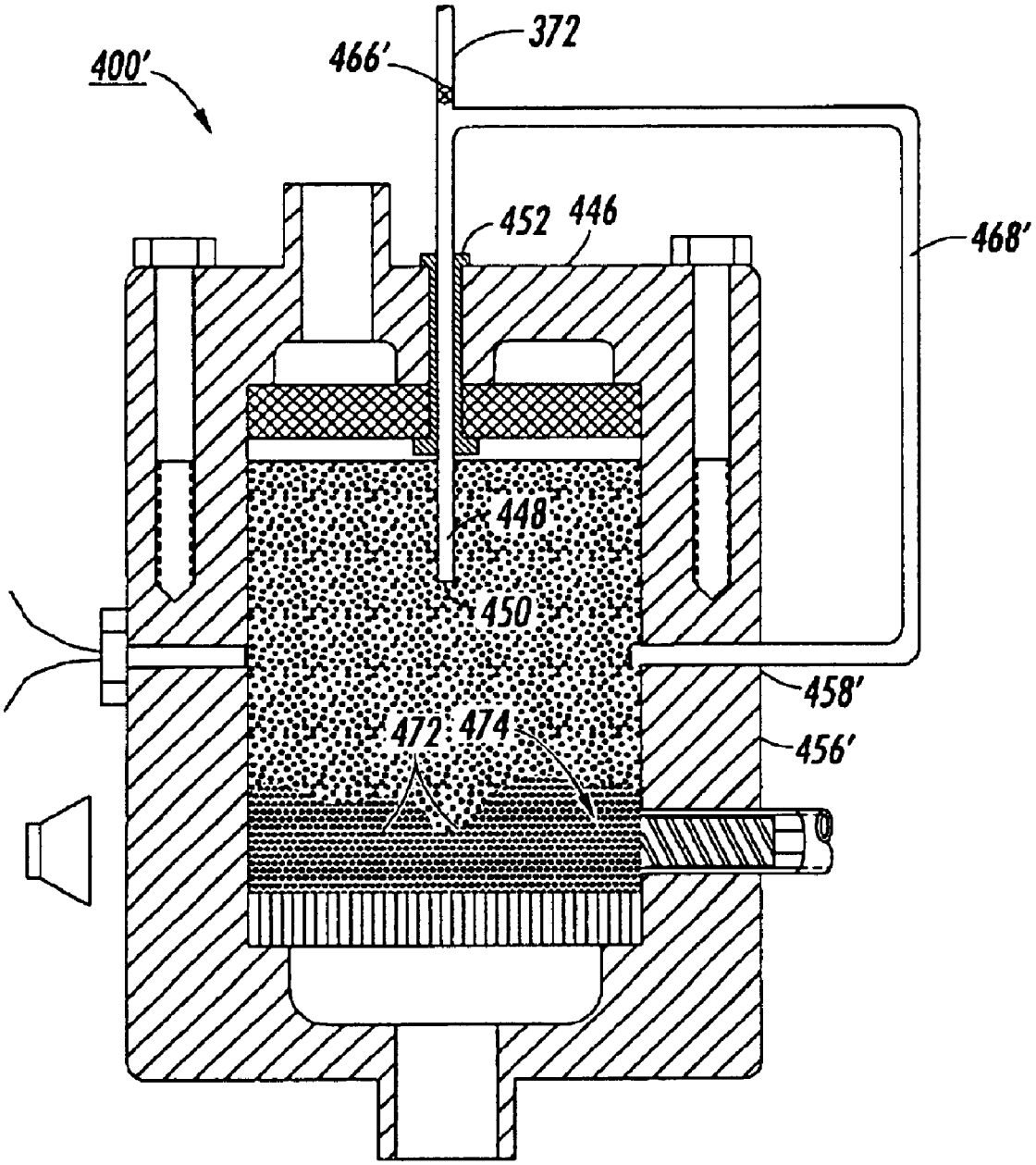
FIG. 14 is a side elevation view, in partial cross-section, of an alternate embodiment of a particulate matter dispensing device in accordance with the present invention shown with a non-fluidized bed of particulate matter.

An alternate embodiment of particulate dispensing device 400' is illustrated in FIG. 14. It will be appreciated that dispensing device 400' is substantially identical to dispensing device 400 discussed hereinbefore with regard to FIG. 13. Accordingly, item numbers corresponding to like features in FIG. 13 will be retained in FIG. 14, and the item numbers for any new or modified features will be primed (') with any features of FIG. 13 not shown in FIG. 14 being distinctly pointed out.

Dispensing device 400' includes a dispensing tube 448 having an open end 450. The dispensing tube extends through passage 446 and is secured therein by a suitable sealing member, such as a grommet 452. Dispensing tube 448 and dispensing line 372 (or 172) can either be joined in a suitable manner or can be of a unitary construction. A valve 466' is disposed along dispensing line 372. A return line 468' extends from the dispensing line and is in fluid communication therewith from a point upstream of valve 466'. The return line extends through a passage 456' in side wall 416 and is secured therein by a suitable sealing member, such as a grommet 458'. The return line is provided in this embodiment to minimize or avoid clogging and buildup of particulate matter flowing into dispensing tube 448 when valve 466' is in a closed or no-flow position.

When employing particulate materials, such a pharmaceutical drugs or other chemicals, for example, in a dry, solid condition having appropriately sized and shaped particles, with proper plasticity, packing density, magnetization, cohesiveness and other properties, the frictional and other binding forces between the particulates in a bed may be sufficiently reduced by a disruption due to a gas passing through the bed of particulate matter such that the particulates take on certain fluid-like, or even aerosol properties in the area of disruption. By providing an aerosol or fluidized bed in the manner described hereinafter, the particulate matter is made to flow evenly and easily, and can be accurately dispensed in consistent amounts.

FIGS. 15–18 show a particulate dispensing device 400 of FIG. 13 having particulate matter 472 and particulate bed 474 in various stages of fluidization. Generating a fluidized or aerosol particulate source requires that particulates 472 resting in bed 474 be lifted out of the bed and into a space 476' thereabove. This can be achieved be flowing gas G, such as carbon dioxide, air or nitrogen, for example, through a dispersive element 440 into the bottom of the bed 474. The gas flows upward through the bed and out of fluidizing chamber 444 through particulate filter 442 as gas G'.

Figure 15:
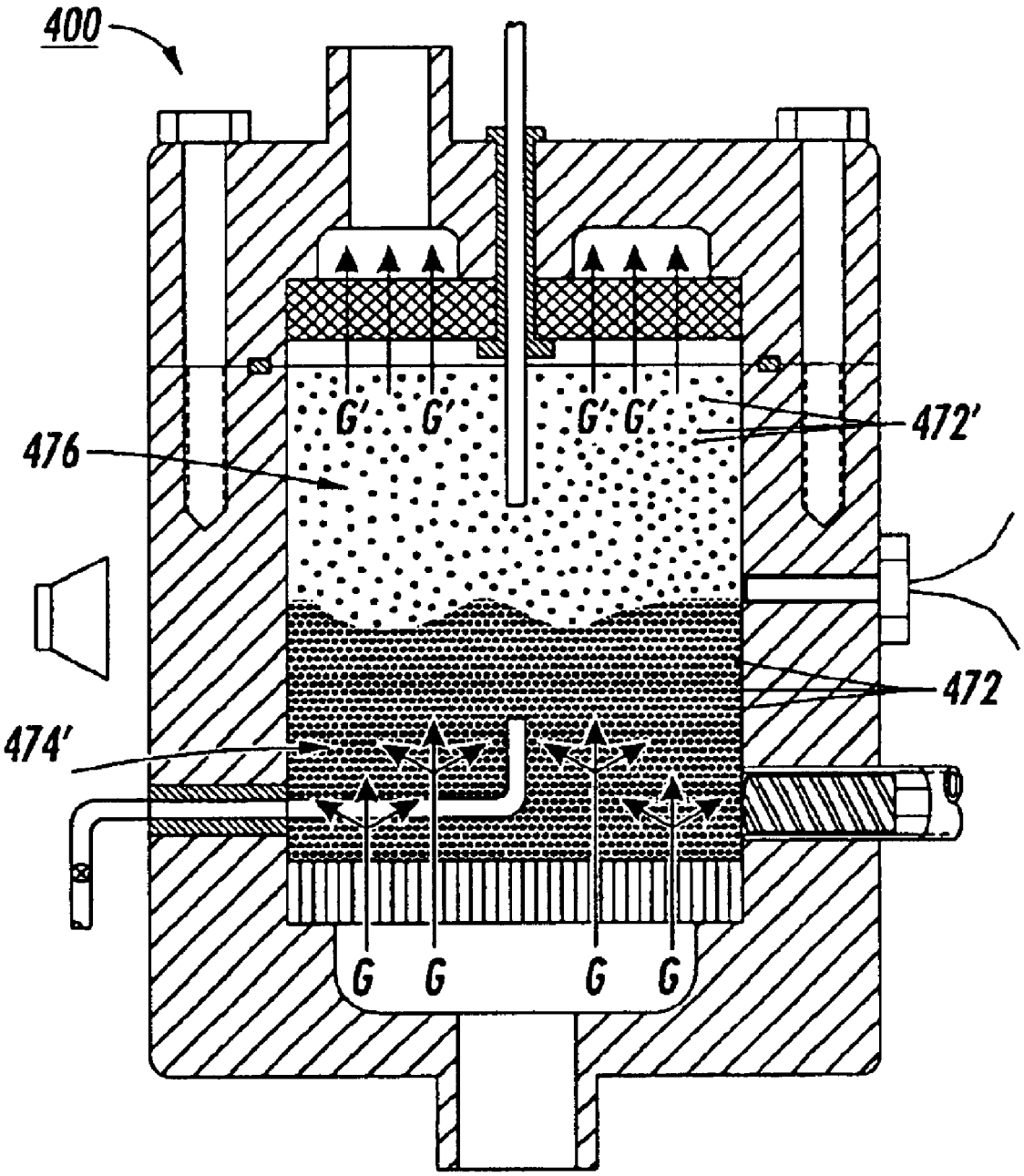
FIG. 15 is a side elevation view, in partial cross-section, of the device in FIG. 13 shown generating .a theoretically ideal fluidized bed with non-interacting particulates and homogenously dispersed gas.

With reference now to FIG. 15, in the ideal case (i.e., for non-interacting particulates), gas G disperses homogenously between the particulates 472 which, once applied air pressure exceeds the weight of bed 474 (shown in FIG. 13), move easily within the pile like molecules in a liquid. In this case, there is a well-defined interface between the now fluidized bed 474' and the region or space 476 above the bed, and a few particulates 472' escape the now fluidized bed 474' forming an aerosol.

By increasing the fluid flow through the fluidized bed 474', the instability of the bed increases and eventually a boiling state is achieved, in which air bubbles rise from the bottom of the bed and collapse at the top, ejecting large amounts of particulates (not shown).

Figure 16:
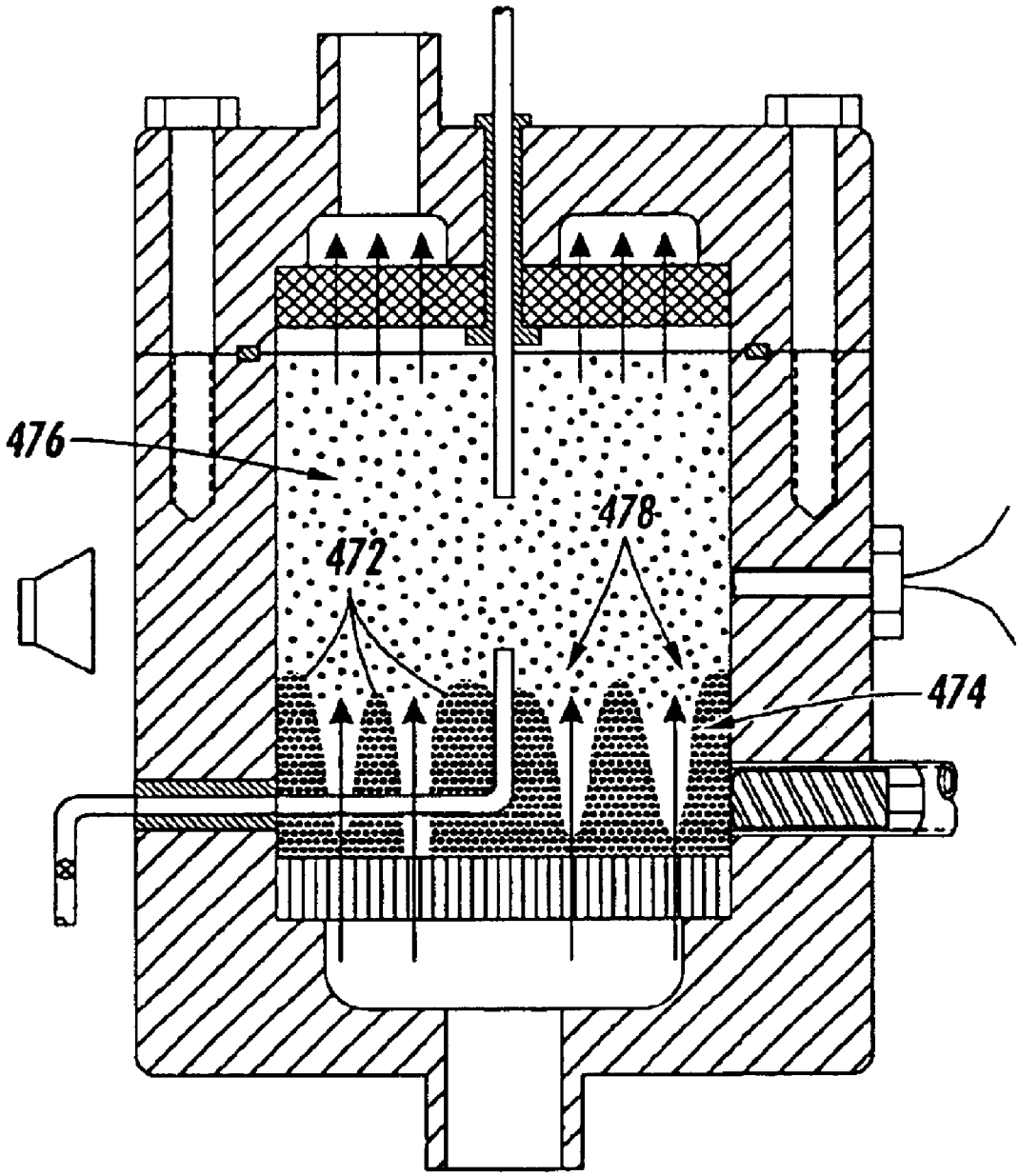
FIG. 16 is a side elevation view, in partial cross-section, of the device in FIG. 13 shown with non-ideal, interacting particulates and blowholes formed within the bed.

If, however, the particulates interact with each other, which is typical for the subject micron-sized particulates, cohesive forces due to Van-der-Waals interactions become dominant and the fluidization mechanism of FIG. 15 is no longer ideal. Instead, the fluid entering into bed 474' seeks the path of least resistance, forming a finite number of so-called gaps or blowholes 478, as illustrated in FIG. 16. Initially, some particulates are ejected through the gaps and into the space 476 above the bed. But after some time an equilibrium state is achieved with well-defined blowholes 478 in an otherwise compact bed 474 of particulates 472.

Figure 17:
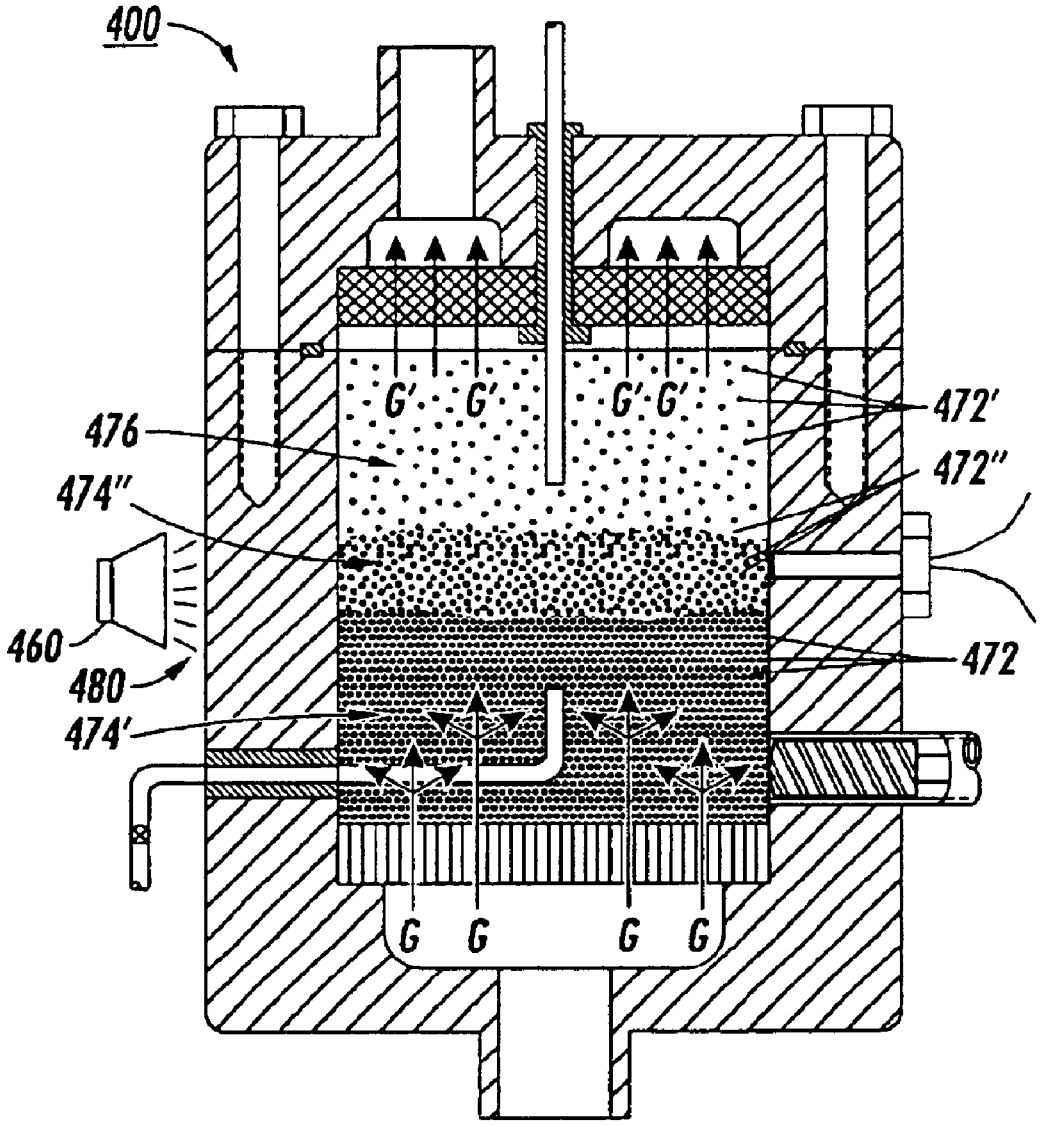
FIG. 17 is a side elevation view, in partial cross-section, of the device and particulates in FIG. 16 shown generating a fluidized bed of non-ideal, interacting particulates with the blowholes destabilized by sonic/ultrasonic vibrations.

However, the blowholes may be destabilized, as shown in FIG. 17, by applying sonic/ultrasonic vibrations 480 to the bed 474 by mechanical or electromechanical means, such as an acoustic speaker 460, or alternately piezoelectric transducer, operating at frequencies from approximately 1 Hz to approximately 30 kHz, depending upon the application. The vibrations lead to a collapse of the walls of the blowholes in the non-fluidized particulate bed 474. As the blowholes collapse, particulate bed 474 is re-fluidized by gas G.

In practice, fluidized bed 474' will have two distinct regions or zones. The primary zone 474' being the lower, more densely populated bed 474' that acts more like a solid than a fluid. A second zone 474" is above the lower zone and is less densely populated with particulates 472" than the lower zone but still far more populated than space 476 above the bed having free floating particulates 472'. The second zone 474" acts much like a liquid and is where the gaps or blowholes burst giving the appearance of boiling.

Figure 18:
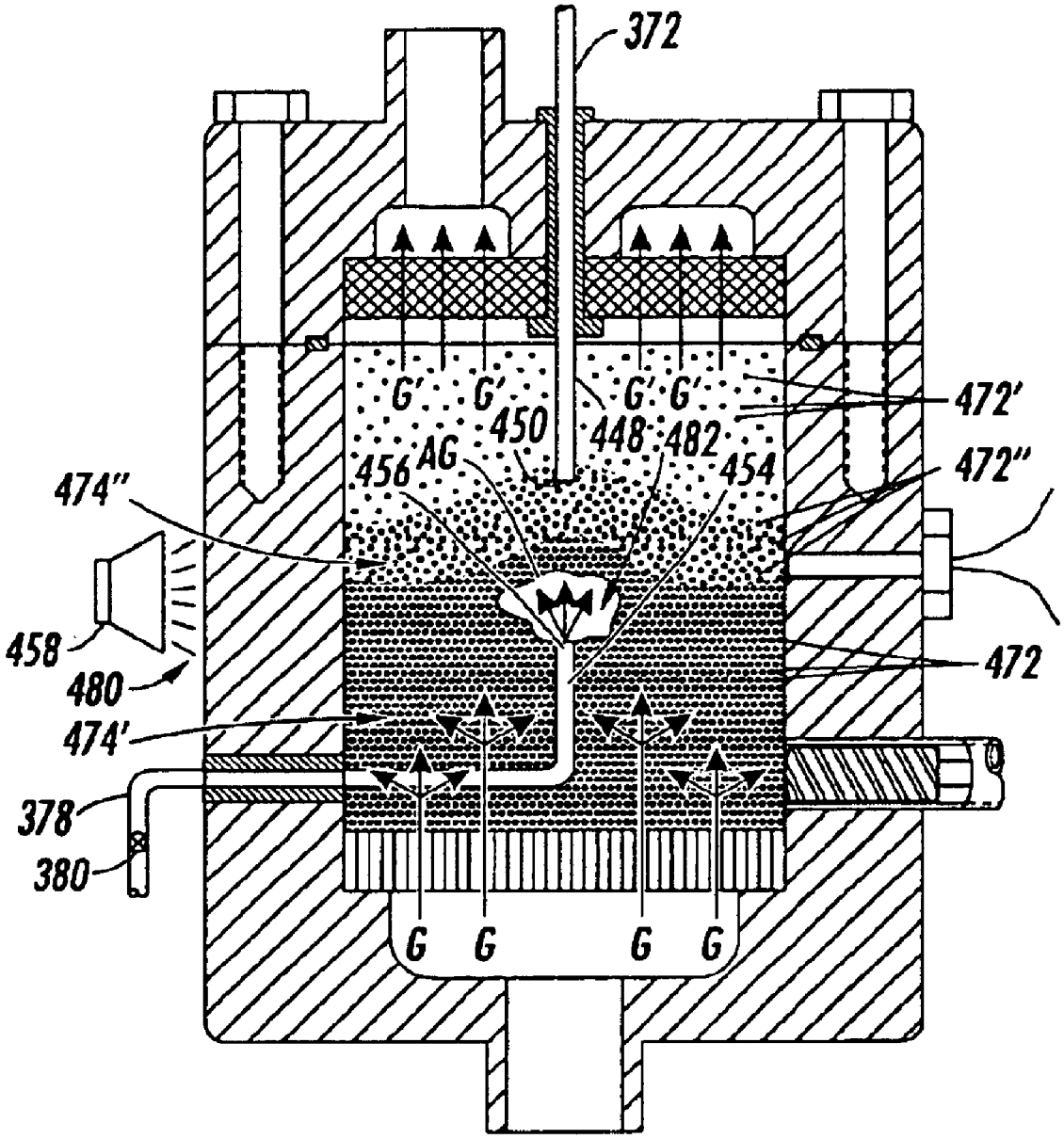
FIG. 18 is a side elevation view, in partial cross-section, of the device and particulates in FIG. 17 shown with localized agitation for urging particulate matter into the dispensing tube.

Having achieved a suitable fluidized bed, as discusses above with regard to FIG. 17, a localized agitation 482 of the bed can be created as shown in FIG. 18. The localized agitation can be generated by any suitable arrangement, such as providing a burst of gas AG from open end 456 of agitation tube 454. Agitation gas AG causes fluidized bed zones 474' and 474" to be temporarily displaced toward open end 450 of particulate dispensing tube 448. As such, a quantity of particles 472 and 472", respectively from zones 474' and 474", are caused to enter the dispensing tube to ultimately be delivered downstream to the target or delivery site. Valve 380 of agitation line 378 is preferably modulated to dispense discrete quantities of particulate matter from device 400 along dispensing line 372 (or 172).

It will be appreciated that in certain situations, the entire fluidized bed can be agitated or burst instead of utilizing local agitation by providing a sudden burst of gas through housing inlet 420, for example. Full-bed agitation, however, has been found in practice to have a relatively slow response time. As such, full-bed agitation may be less suitable for certain applications. It will be appreciated, however, that full-bed agitation is intended to come within the scope of the present invention. Furthermore, because the boiling of a particulate bed has been found to be caused by the continual creation and destruction of gaps or blowholes in the particulates bed, other designs and corresponding methods of fluidization are clearly possible. An alternate configuration (not shown) consists of replacing the dispersive element in the dispensing device with a series of small openings (not shown) formed, such as by glass capillaries with diameters of 100 $\mu$m or smaller, for example. By using individual, small-scale, high-velocity fluid sources, for example, certain details in the foregoing discussion regarding the creation of a fluidized particulate matter or aerosol, as shown in FIGS. 16 and 17, can be avoided. Under this arrangement, the gaps in the bed form immediately due to the high-velocity fluid at the exit of the capillaries. The holes are subsequently collapsed by sonic/ultrasonic vibration generated, for example by an acoustic speaker or a piezoelectric actuator. The advantage of this scheme is that the number and uniformity of the regions of the bed generating aerosol particulates can be controlled by varying the number, distribution, and diameter of the capillaries used.

Turning now to the operation of a system in accordance with the present invention, such as systems 100 and 200, a delivery site, such as substrate ST, is provided and supported in a support structure SR. The delivery site is positioned adjacent delivery member 110 such that propellant flowing along delivery channel 112 is directed at the delivery site. The propellant flow can be continuous or modulated, such as by selectively activating and deactivating an actuator (not shown) associated with valve 148. Each of the one or more particulate dispensing devices 400 selectively receives and vents fluid respectively through supply line 160 and discharge line 166 by activating and/or deactivating actuators (not shown) respectively associated with valves 162 and/or 168. The fluid flow through the particulate-dispensing device can be modulated by such selective activation and/or deactivation, or can be continuous. In any case, a quantity of particulate matter 472 in fluidizing chamber 444 forms a fluidized bed 474', and fluidized particulate matter 472 and 472" that is dispensed from device 400 through particulate dispensing line 172 into the propellant flowing along channel 112. The propellant carries the particulates 472 and 472" along the channel and delivers them to a delivery site, such as substrate ST, where the particulates are suitably deposited.

In the operation of system 300 shown in FIGS. 11 and 12, a series of delivery sites, such as substrates ST, for example, are provided on support structure SR or any other suitable conveyor arrangement. Preferably, the support structure moves the delivery sites along a conveyor path past any suitable number of material outputs, such as particulate dispensing lines 372 or nozzle arrangements 316 of adhesive dispensers 310. As the delivery sites pass by the material outputs, the conveyor can stop or slow down during the delivery of material from the material outputs, or alternately the conveyor can travel along at a constant pace. It will be appreciated that the use of adhesive will be better suited for some applications than for others and, therefore, the use of adhesive is optional in this or other systems. It will be further appreciated that other devices can also be positioned along the conveyor path and/or integrated into the system. Each of the particulate dispensing devices 400 (or alternately 400') selectively receives and exhausts fluid respectively through supply line 360 and discharge lines 366 by activating and/or deactivating actuators (not shown) respectively associated with valves 362 and/or 368. The fluid flow through the particulate dispensing device is preferably modulated by such selective activation and/or deactivation of valve 380 along agitation line 378 (or alternately valve 466' along dispensing line 372), or in certain applications the fluid flow can be continuous. In any case, a quantity of particulate matter 472 in fluidizing chamber 444 forms a fluidized bed 474', and fluidized particulate matter 472, 472' and 472" that is dispensed from device 400 through particulate dispensing tube 448 and dispensing line 372 is delivered to the delivery site, such as substrate ST, for example, where the particulates are suitably deposited.

Figure 19:
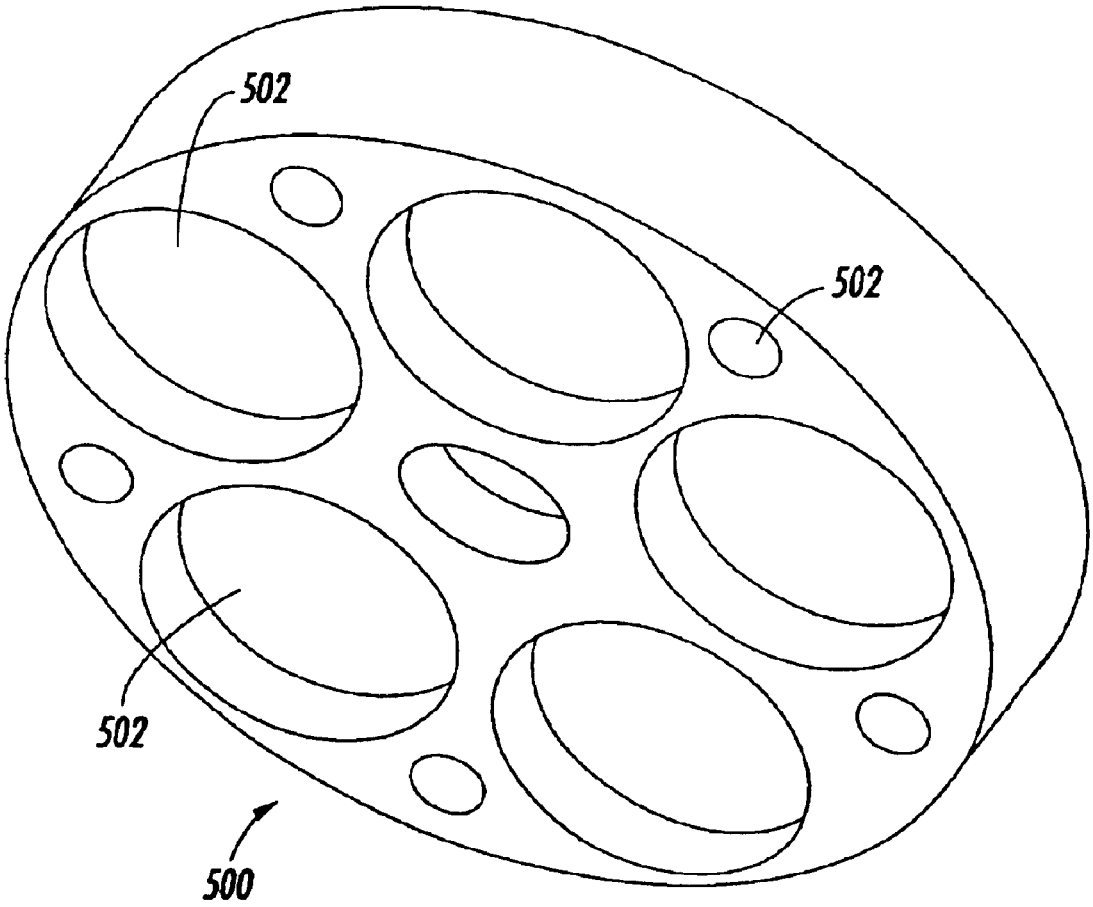
FIG. 19 is a perspective view of one embodiment of a pill substrate having cavities for receiving and retaining one or more chemical compounds.

The foregoing discussion of depositing a layer of particulate matter on substrate ST can thereafter be repeated, using the one or more different particulates to form a multi-layered pill. Such pills can have any suitable or desired configuration. For example, a pill could have a substrate, such as cellulose, for example, that is generally in the shape or form of the desired pill. A first layer of adhesive is applied to one or more areas or sides of the pill. A second layer of particulate matter M1 is applied over the adhesive. A third layer made of adhesive is applied over the second layer, and a fourth layer formed from a combination of two other particulate matters M2 and M3. Thereafter, a further layer of adhesive is applied over the fourth layer and a coating layer is thereafter delivered over the adhesive to form the exterior of the pill. Another substrate 500 is conceptually shown in FIG. 19. Rather than forming layers, however, substrate 500 includes cavities 502 of various shapes and sizes, which can be filled with various combinations of particulate matters, such as M1, M2 and M3, as desired. After the cavities have been suitably filled, a coating layer could be applied to form the exterior of the pill. It will be appreciated that particulate matters M1, M2 and M3 can be different matters, or the same matter in a different concentration, and that the present invention is not intended to be limited to use with any particular number of different matters. As such, it will be appreciated that this foregoing example is simply one example of a pill manufactured with a device and system of the present invention, and that the foregoing example is not intended to be in any way limiting of the present invention. It should be further appreciated that in the foregoing example, each of the various layers could be applied by a different delivery member each having a different particulate matter, or by one or more delivery members each having one or more different particulate matters. In either case, the pill can be moved from a position adjacent one delivery member to the next, as necessary, until the final layer has been applied to the pill.

While considerable emphasis has been placed on the preferred embodiments of the invention illustrated and described herein, it will be appreciated that other embodiments can be made and that many modifications can be made in the embodiments shown and described without departing from the principles of the present invention. Obviously, such modifications and alterations will occur to others upon reading and understanding the preceding detailed description, and it is intended that the subject invention be construed as including all such modifications and alterations insofar as they come within the scope of the appended claims or the equivalents thereof. Accordingly, it is to be distinctly understood that the foregoing descriptive matter is to be interpreted merely as illustrative of the invention and not as a limitation.

What is claimed is:

1. A particulate dispensing device comprising:

a housing having a housing wall at least partially defining a housing cavity;

a dispersive element supported in said housing cavity;

a particulate filter supported in said housing cavity in spaced relation to said dispersive element forming a fluidizing chamber therebetween; and, a dispensing tube having a tube wall and a dispensing passage at least partially formed by said tube wall and in fluid communication with said fluidizing chamber.

2. A particulate dispensing device according to claim 1, wherein said housing wall is a housing side wall and said housing includes a top wall and a bottom wall, said dispersive element is supported adjacent said bottom wall, and said particulate filter is supported adjacent said top wall.

3. A particulate dispensing device according to claim 1, wherein said housing includes an inlet passage and an outlet passage each in fluid communication with said housing cavity.

4. A particulate dispensing device according to claim 1, wherein said dispersive element is a first dispersive element, and said particulate filter includes a second dispersive element.

5. A particulate dispensing device according to claim 1 further comprising an agitation tube having an agitation tube wall and an agitation passage at least partially formed by said agitation tube wall and in fluid communication with said fluidizing chamber.

6. A particulate dispensing device according to claim 1 further comprising a valve in fluid communication with said agitation passage for selectively controlling fluid flow therethrough.

7. A particulate dispensing device according to claim 6, wherein said valve is a piezoelectric valve.

8. A particulate dispensing device according to claim 1 further comprising a vibration source positioned adjacent said fluidizing chamber.

9. A system for delivering particulate matter to a delivery site, said system comprising:

a particulate dispensing device including a housing having a housing wall and a housing cavity formed at least partially by said housing wall, a dispersive element supported in said housing cavity, a particulate filter supported in said housing cavity in spaced relation to said dispersive element and forming a fluidizing chamber therebetween, a dispensing tube having an intake opening positioned within said fluidizing chamber, a delivery opening, and a dispensing passage extending between said intake and delivery openings, and a fluid inlet passage and a fluid outlet passage each in fluid communication with said housing cavity; and, a fluid source in fluid communication with said fluid inlet passage.

10. A system according to claim 9, further comprising a valve in fluid communication with one of said fluid inlet passage and said fluid outlet passage for at least partially selectively controlling fluid flow through said housing cavity.

11. A system according to claim 9, wherein said particulate dispensing device includes an agitation tube having an agitation tube wall and an agitation passage at least partially formed by said agitation tube wall and in fluid communication with said fluidizing chamber.

12. A system according to claim 11, wherein said particulate dispensing device includes a valve in fluid communication with said agitation passage for selectively controlling fluid flow therethrough into said fluidizing chamber.

13. A system according to claim 12, wherein said valve is a piezoelectric valve.

14. A system according to claim 9, wherein said delivery opening of said dispensing tube is positioned adjacent the delivery site.

15. A system according to claim 14 further comprising a nozzle in fluid communication with said dispensing passage for modifying fluid flow therealong.

16. A system according to claim 9 further comprising a delivery member having a wall defining a delivery channel extending longitudinally along said delivery member, and a propellant source in fluid communication with and providing propellant flow along said channel, said delivery channel having an open end positioned adjacent the delivery site.

17. A system according to claim 16 further comprising a valve fluidically positioned between said propellant source and said delivery channel.

18. A system according to claim 16, wherein said dispensing passage of said dispensing tube is in fluid communication with said delivery channel.

19. A system according to claim 16, wherein said delivery channel includes a nozzle for modifying flow through said delivery channel.

20. A method of delivering particulate matter to a delivery site comprising the steps of:

providing a fluidizing chamber and a quantity of particulate matter within said fluidizing chamber;

fluidizing said quantity of particulate matter;

providing localized agitation within said fluidizing chamber; and, delivering a portion of said quantity of fluidized particulate matter to the delivery site.

21. A method of delivering particulate matter to a delivery site comprising steps of:

a) providing a fluidizing chamber and a dispensing tube forming a dispensing passage having an intake opening disposed within said chamber and a dispensing opening disposed outside said chamber;

b) providing a quantity of particulate matter within said chamber;

c) fluidizing said quantity of particulate matter; and, d) dispensing a portion of said quantity of fluidized particulate matter through said dispensing passage of said dispensing tube.

22. A method according to claim 21 further comprising steps of providing a valve operatively associated with said dispensing tube and modulating said valve to selectively dispense said portion of said quantity of fluidized particulate matter.

23. A method according to claim 21 further comprising a step of providing localized agitation within said fluidizing chamber.

24. A method according to claim 21 further comprising steps of providing a flow channel having an open end and propellant source in operative association with said flow channel and spaced from said open end, and creating a propellant flow along said flow channel.

25. A method according to claim 24 further comprising a step of modifying said propellant flow along said flow channel using a nozzle arrangement.

26. A method according to claim 24, wherein said dispensing opening of said dispensing tube is in fluid communication with said propellant flow, and step d) includes dispensing said portion of said quantity of fluidized particulate matter through said dispensing tube into said propellant flow for transport toward said open end of said flow channel.

27. A method according to claim 26 further comprising steps of positioning a delivery substrate adjacent said open end of said flow channel and delivering said portion of said quantity of fluidized particulate matter along said flow channel to said delivery substrate.

28. A method according to claim 27 further comprising impacting said portion of said quantity of fluidized particulate matter with said delivery substrate.

29. A method according to claim 27, wherein said delivery substrate is a pill substrate having a plurality of cavities, and said step of delivering said portion of said quantity of fluidized particulates includes directing said portion into one of said cavities.

* * * * *